US005870980A

United States Patent [19]

Hooper et al.

[11] Patent Number: 5,870,980

[45] Date of Patent: Feb. 16, 1999

[54] STEPPED PISTON INTERNAL COMBUSTION ENGINE

[76] Inventors: Bernard Hooper, High Woodland, Littlegain, Hilton, Near Bridgnorth, Shropshire, United Kingdom, WV15 5PA; Peter R Hooper, 24 Goodwood Avenue, Bridgnorth, Shropshire, United Kingdom, WV15 5BD

[21] Appl. No.: 792,505

[22] Filed: Jan. 31, 1997

[30] Foreign Application Priority Data

Feb. 1, 1996 [GB] United Kingdom ..... 9602063
May 18, 1996 [GB] United Kingdom ..... 9610477

[51] Int. Cl.[6] ..... F02B 75/06

[52] U.S. Cl. ..... 123/58.6; 123/65 S

[58] Field of Search ..... 123/62, 58.5, 58.6, 123/73 F, 65 S

[56] References Cited

U.S. PATENT DOCUMENTS

| | | | |
|---|---|---|---|
| 880,958 | 3/1908 | Bachle et al. | 123/58.6 |
| 997,258 | 7/1911 | Bachle et al | 123/58.6 |
| 1,020,128 | 3/1912 | Coles et al. | 123/58.6 |
| 1,056,690 | 3/1913 | Kilgore | 123/58.6 |
| 1,065,491 | 6/1913 | Zolle | 123/58.6 |
| 1,115,481 | 11/1914 | Bachle | 123/58.5 |
| 1,127,322 | 2/1915 | Tuttle | 123/58.5 |
| 1,138,742 | 5/1915 | Fried | 123/58.6 |
| 1,138,876 | 5/1915 | Leech | 123/58.6 |
| 1,208,805 | 12/1916 | Lonaberger et al. | 123/58.5 |
| 1,436,130 | 11/1922 | Webb | 123/58.5 |
| 1,601,344 | 9/1926 | Burtnett | 123/58.5 |
| 4,169,434 | 10/1979 | Guenther | 123/47 A |
| 4,696,267 | 9/1987 | Kohno et al. | 123/192.2 |
| 5,365,899 | 11/1994 | Doragrip | 123/192.2 |

FOREIGN PATENT DOCUMENTS

| | | |
|---|---|---|
| 186669 | 9/1922 | United Kingdom . |
| 190757 | 9/1922 | United Kingdom . |
| 207173 | 2/1924 | United Kingdom . |
| 240456 | 4/1926 | United Kingdom . |
| 499216 | 1/1939 | United Kingdom . |
| 538962 | 8/1941 | United Kingdom . |
| 2214569 | 6/1989 | United Kingdom . |
| 2226596 | 4/1990 | United Kingdom . |
| 2249585 | 5/1992 | United Kingdom . |
| 2248654 | 9/1993 | United Kingdom . |
| 2288637 | 10/1995 | United Kingdom . |
| WO83/01985 | 6/1983 | WIPO . |

*Primary Examiner*—David A. Okonsky

[57] ABSTRACT

A stepped-piston, internal-combustion engine includes at least one cylinder, each cylinder having a working part of lesser diameter defined by a cylindrical wall and a pumping part of greater diameter, a piston slidable in each cylinder, a receiver which is partly delimited by the cylindrical wall of the working part of each cylinder and which extends at least partly around each working part, working inlet ports in the cylindrical wall and extending between the working part of the cylinder and the receiver and valve means to control the entry of charge into the pumping part of each cylinder and the transfer of charge from said pumping part to the receiver, and wherein the admission of charge into the working part of each cylinder from the receiver is controlled by the uncovering of the working inlet ports by the working part of the piston.

9 Claims, 9 Drawing Sheets

STEPPED PISTON INTERNAL COMBUSTION ENGINE

BACKGROUND OF THE INVENTION

1. Field of the Invention

This invention relates to stepped-piston, internal-combustion engines having one or more cylinders each containing a stepped piston having a pumping part of larger diameter and a working part of smaller diameter, the working part of the piston being slidable in a working part of the cylinder and the pumping part of the piston being slidable in a pumping part of the cylinder. Combustion of fuel and air mixture takes place in the working part of each cylinder. Inlet ports (hereinafter referred to as "working inlet ports") are provided in the wall of the working part of the or each cylinder. At least one pump port is provided in the pumping part of the or each cylinder to enable a fresh charge to be induced into said pumping part and transferred from the pumping part to a receiver. The charge then passes from the receiver to the working inlet ports. The or each piston is connected to a crankshaft by connecting rods or other means for converting reciprocating motion into rotary motion. Such an engine is hereinafter referred to as "an engine of the kind specified". The charge introduced into the working part of the or each cylinder will be air only if the engine is a compression-ignition engine and a fuel-air mixture if the engine is a spark-ignition engine.

2. Description of the Prior Art

A number of prior proposals have been made for engines of the kind specified. An example of such a proposal is that described in GB-A-190,757. One embodiment described includes two cylinders in separate cylinder blocks having a common receiver which is provided in a member separate from the cylinder blocks and located between the two blocks and connected to the tops of the cylinders by pipes. A single rotary valve is employed to control the inlet of charge into the pumping part of each of the two cylinders and also to control the transfer of the charge from each pumping part into the common receiver. Inside the common receiver is a sleeve valve which is reciprocated by a connecting rod connected to the rotary valve and which is arranged to open ports in the wall of the receiver at the appropriate times to permit charge which has been pumped into the receiver by the pumping parts of the cylinders to be discharged down the pipes from the receiver into the tops of the working parts of the cylinders. A single cylinder version of the engine is also described.

GB-A-190,757 was applied for in 1921 and is a construction which is suitable for slow running two-stroke engines. In this arrangement the receiver is completely separate from the cylinder blocks, is of comparatively small volume having to fit between and to one side of the two cylinder blocks and the charge from the receiver into the cylinders is controlled by the sleeve valve mentioned above which is expensive and complicated. The arrangement described would not be suitable for high speed, two-stroke engines for modern automotive use.

BRIEF SUMMARY OF THE INVENTION

The object of the invention is to provide an engine of the kind specified which is of simple construction and which enables the receiver to be made of an appropriate volume for high speed use.

According to the invention we provide a stepped-piston, internal-combustion engine comprising at least one cylinder, the or each cylinder having a working part defined by a cylindrical wall and a pumping part, said pumping part being of greater diameter than the working part, a piston in the or each cylinder and having a working part slidable in the working part of the cylinder and a pumping part slidable in the pumping part of the cylinder, a crankshaft, means connecting the or each piston to the crankshaft, a receiver which is partly delimited by said cylindrical wall of the working part of the or each of at least some of the cylinders and which extends at least partly around each said working part on both sides of the central plane of the engine, working inlet ports in the or each said cylindrical wall and extending between the working part of the or each of said some cylinders and the receiver, at least one valve control member mounted for rotation about an axis parallel to the crankshaft axis at a speed dependent on the rotational speed of the crankshaft, and valve means associated with the or each cylinder to control the entry of charge into the pumping part of the cylinder and the transfer of charge from said pumping part to the receiver, the valve means being operated by said valve control member, and wherein the admission of charge into the worldling part of the or each of said some cylinders from said receiver through the working inlet ports is controlled solely by the uncovering of said working inlet ports by the working part of the piston.

Herein the term "central plane of the engine" is used to mean the plane containing the axis of rotation of the crankshaft and the longitudinal axis or axes of the cylinder(s) except for an engine of Vee-configuration wherein the "central plane of the engine" is used to mean either the plane containing the axis of rotation of the crankshaft and which bisects the planes containing the longitudinal axes of the cylinders of each bank if the engine has a single receiver or, if there is a receiver for each bank, each of the planes containing the axis of rotation of the crankshaft and the axes of the cylinders in one of the banks; in this latter case there are two "central planes".

In an engine embodying the invention the inlet of the charge from the receiver into the working part of the or each cylinder through the working inlet ports is controlled by the working part of the piston in the working part of the cylinder, normally the top of the piston, uncovering said ports. Thus the sleeve valve which is required in the example of the prior art referred to above is dispensed with.

Secondly, the receiver partly surrounds the working part of the or each cylinder so that it may be made of large volume and form part of the cylinder block casting of the engine. The external walls of the receiver may be formed by said casting or by cover plates secured to the casting. The working part of the or each cylinder shares a wall with the receiver, i.e. they have a common wall, and the working inlet ports pass through this wall so that the charge has only a very short distance to pass from the receiver into the working part of the or each cylinder.

Preferably, the valve control member is in the form of a shaft which carries balance weights to counteract any rocking couple of the engine. The balance weights will normally be carried adjacent the ends of the shafts.

In one particularly advantageous form of the invention the valve control member is a rotary shaft which drives the valve means which comprises, for the or each cylinder, an open-ended valve member defined by a cylindrical wall the space within said valve member being divided into two parts by a diaphragm inclined to the longitudinal axis of the cylindrical wall, there being a valve port in said cylindrical wall of the valve member in each of said parts, and wherein during rotation of the shaft one of the valve ports allows the flow of charge through one open end of the valve member into the pumping part of the cylinder and the other of said valve ports allows the flow of charge from the pumping part of the cylinder through the other open end of the cylinder into the receiver.

Where the engine has multiple cylinders in a line each of said valve members is preferably supported in a ported housing and the valve members are splined to the shaft. The shaft therefore drives the valve members but does not support them, this function being taken by the housing. In other embodiments of the invention the valve means may be in the form of poppet valves or flap valves.

Preferably the charge is delivered into the receiver on one side of the central plane of the engine, is caused to flow across the central plane and then to reverse its direction of flow before reaching the working inlet ports of the working part of the or each of the cylinders which is or are in communication with said receiver via said ports. A baffle may be provided in the receiver which extends across the central plane of the engine from said one side and has a free end on the other side of said central plane around which the charge passes to reverse its direction of flow before reaching said inlet working ports.

Preferably where there are multiple cylinders there is a common receiver for all the cylinders, the working inlet ports of all the cylinders communicating with the common receiver into which charge from the pumping parts of all said cylinders is delivered. This may also be the case with an engine having the cylinders in Vee configuration if the angle of the Vee is not too large.

In another construction, however, where multiple cylinders are arranged in Vee configuration in two banks there may be two receivers, one receiver being common to the cylinders of one bank and the other receiver being common to the cylinders of the other bank, the working inlet ports of all the cylinders of each bank communicating with its common receiver into which charge from the pumping parts of all the cylinders of the bank are delivered.

Engines embodying the invention may have at least one exhaust port in the cylindrical wall of the working part of the or each cylinder, the exhaust port or ports being opened or closed by the working part of the piston. In an alternative arrangement there is at least one, preferably more, exhaust valve(s) in the working part of the or each cylinder which is or are operated by means driven from the crank shaft. Normally such means will include a cam shaft.

BRIEF DESCRIPTION OF THE DRAWINGS

The invention will now be described by way of example with reference to a two-stroke (two-cycle) engine and with reference the accompanying drawings in which.

DESCRIPTION OF PREFERRED EMBODIMENTS

Figure 1:
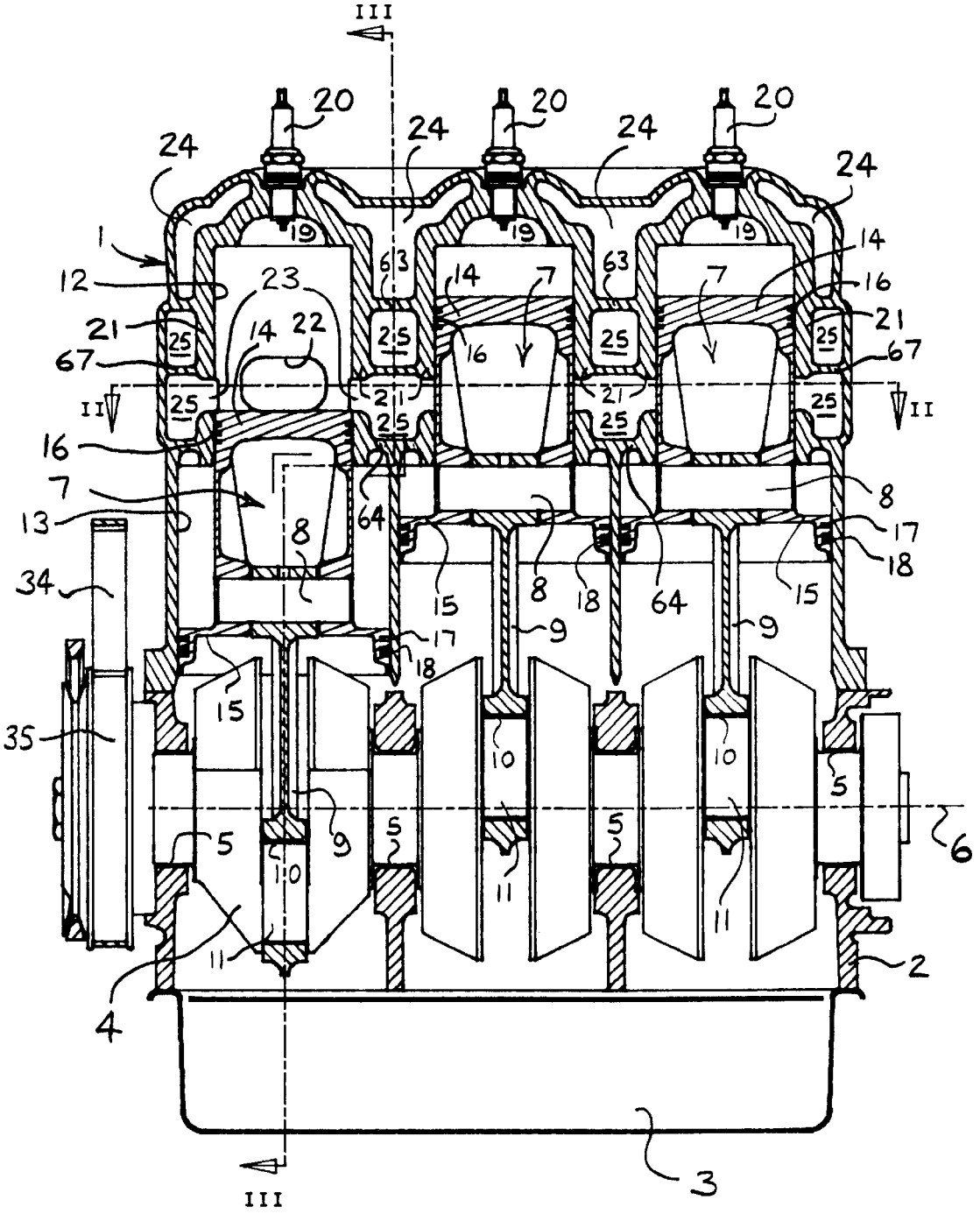
FIG. 1 is a longitudinal section through a three-cylinder, in-line engine employing loop scavenging in the central plane of the engine, i.e. in the plane of the crank shaft and the cylinder axes.

Referring to FIGS. 1 to 4 of the drawings, the engine includes a cylinder block 1, crankcase 2, oil sump 3 and a crankshaft 4 running in bearings 5 mounted in the crankcase 2 and having a longitudinal axis 6. Stepped pistons 7 are coupled to the crankshaft 4 by wrist pins 8 and connecting rods 9 supported by bearings 10 running on the crank-pins 11 of the crankshaft 4. The cylinder block 1 contains three cylinders, each with a smaller diameter working part 12 and an associated larger diameter pumping part 13. Each piston 7 has a working part 14 slidable in the working part 12 of a cylinder and a pumping part 15 slidable in the pumping part 13 of the cylinder. Pistons 7 are provided with compression rings 16 and 17 and oil control rings 18. At the upper end of each cylinder is a combustion chamber 19 and a spark plug 20. The working part of each cylinder 12 has a cylindrical wall 21 in which are provided an exhaust port 22 and working inlet ports 23. Water cooling spaces are provided in the cylinder block and some of these are shown at 24.

The engine includes a receiver indicated generally at 25. As will be seen from FIGS. 1 and 2, the receiver 25 partially surrounds each of the working parts of the cylinders. The receiver is defined in part by the cylindrical wall 21 of the working part of each cylinder and communicates directly with each such working part through the working inlet ports 23. The receiver is also defined laterally by vertical walls 26 bounding the water spaces 24 and other vertical walls 27 bounding the ports of the pumping parts of the cylinders. The receiver also extends into spaces 28 and 29 shown in FIGS. 2 to 4 as will hereinafter be described.

By making the receiver partially surround the working parts of the cylinders the receiver can be made comparatively large. It can either be formed as shown when the cylinder block is cast or the cylinder block may have plates, not shown, secured to its sides which will close the receiver at the exterior of the engine.

Figure 2:
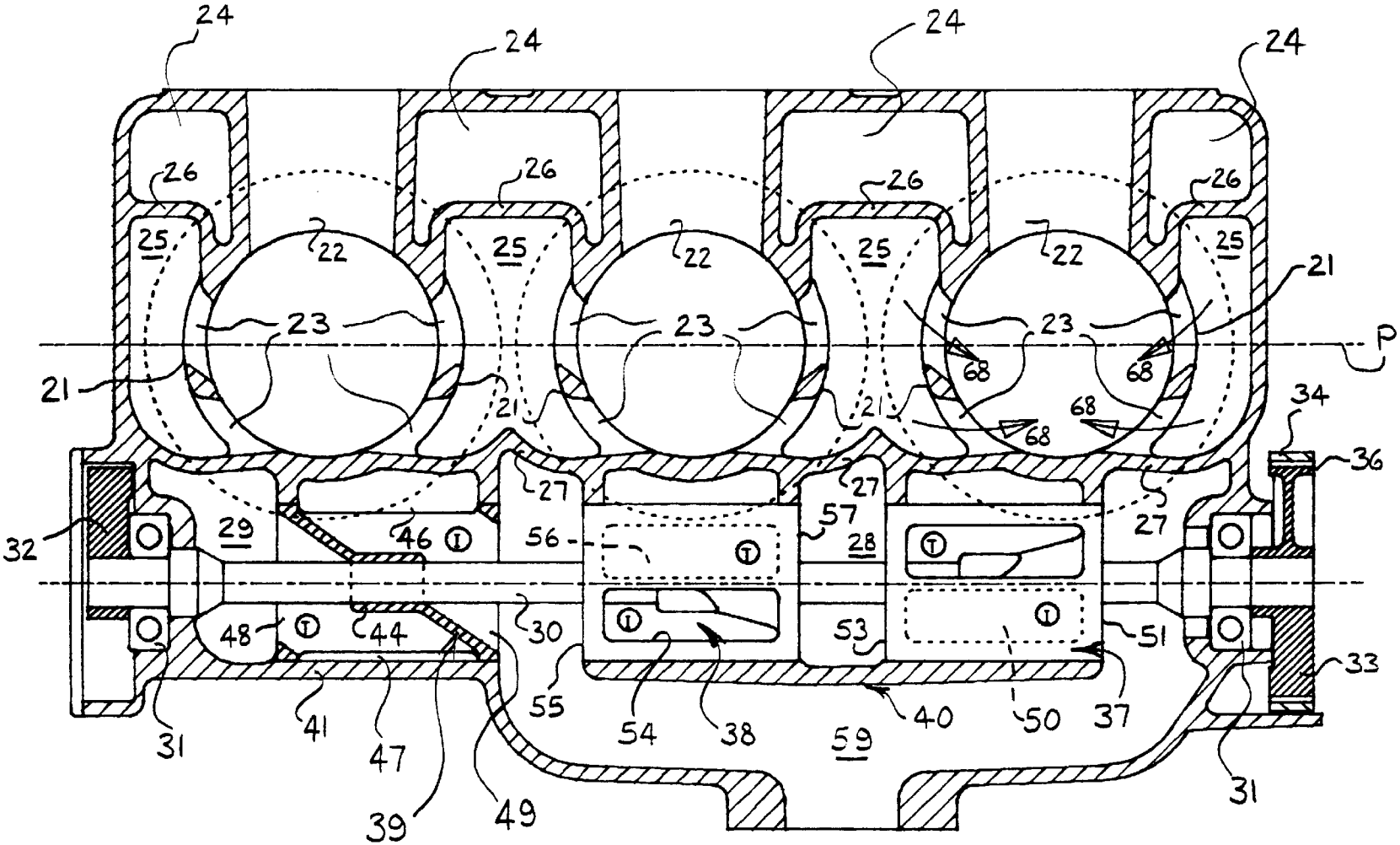
FIG. 2 is a horizontal transverse section of the engine of FIG. 1 on the line II—II of FIG. 1 but with the front of the engine at the right rather than at the left as in FIG. 1.
Figure 3:
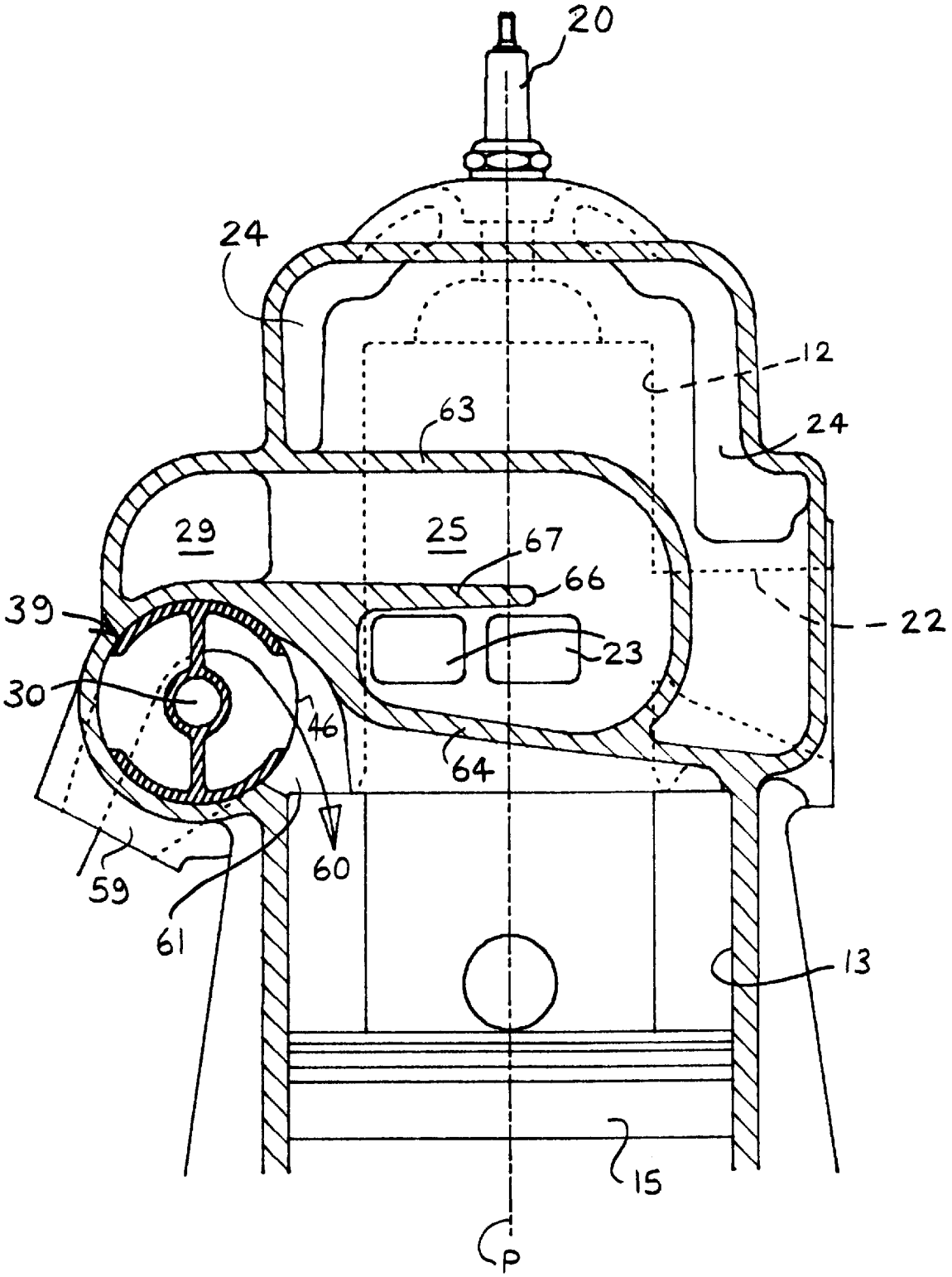
FIG. 3 is a partial transverse section through one of the cylinders of the engine of FIG. 1 on the line III—III of FIG. 1 showing the induction of charge into the pumping part of a cylinder with the piston between top and bottom dead centres.
Figure 4:
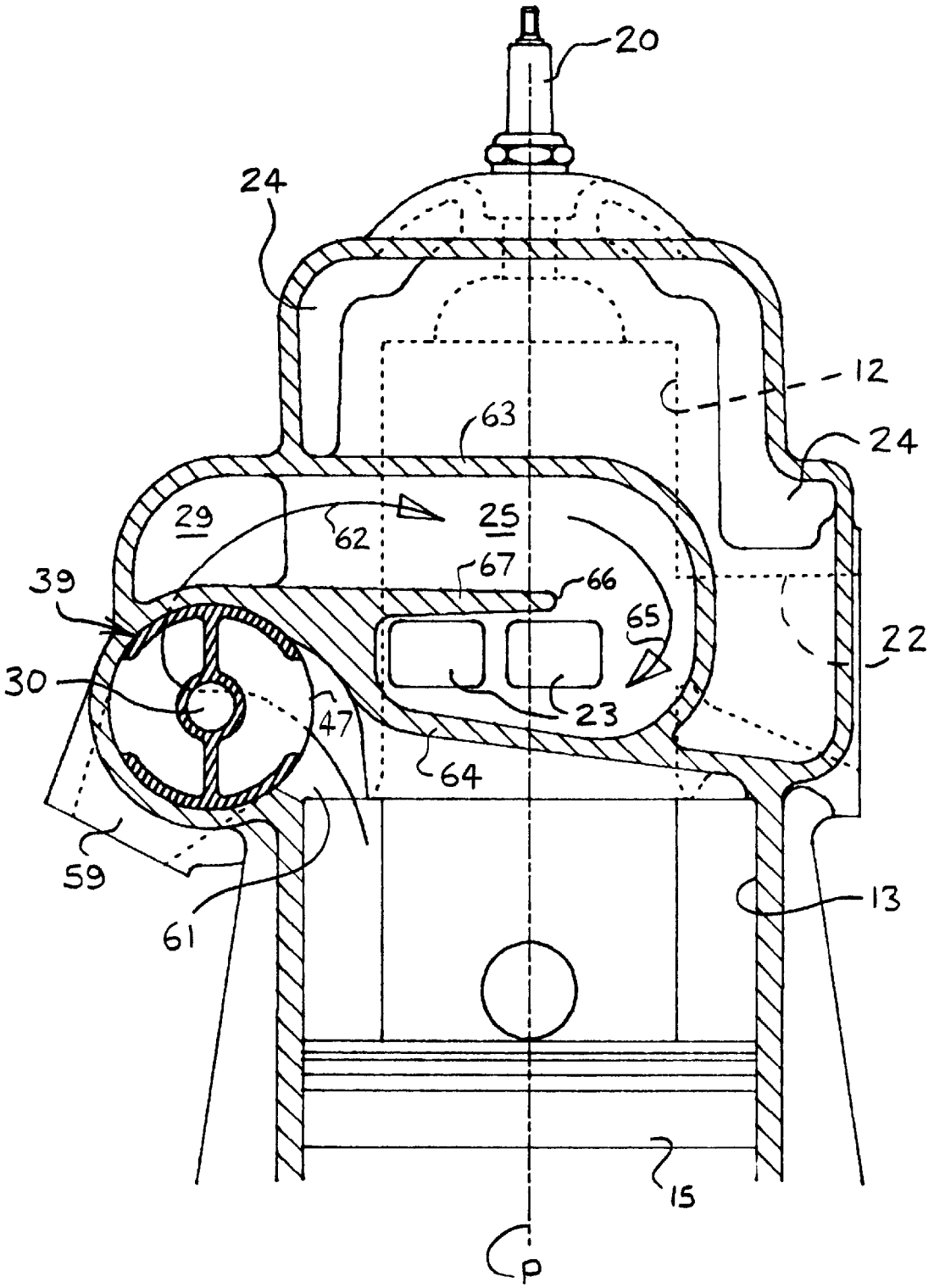
FIG. 4 is a view similar to FIG. 3 showing the transfer of charge from the pumping part of the cylinder into a receiver.
Figure 5:
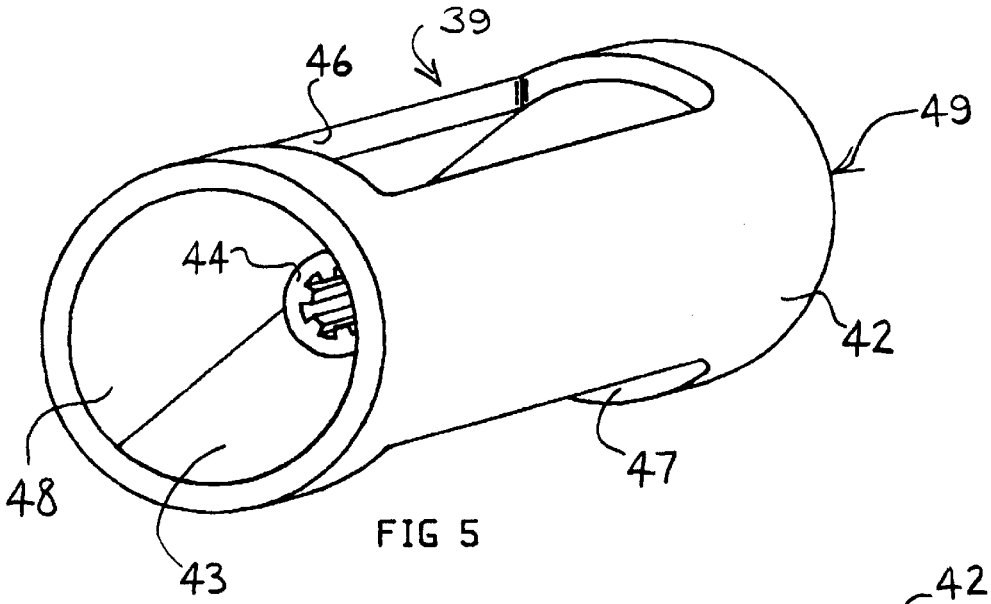
FIG. 5 is a perspective view of one of the rotary valve members shown in the engine of FIGS. 1 to 4.
Figure 7:
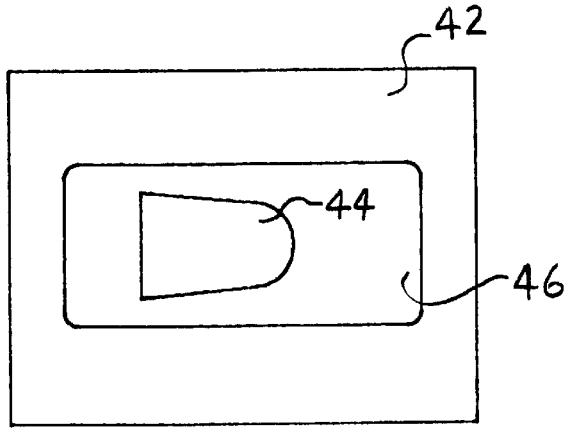
FIGS. 7 and 8 are side and end elevations respectively of the valve member of FIG. 5.
Figure 8:
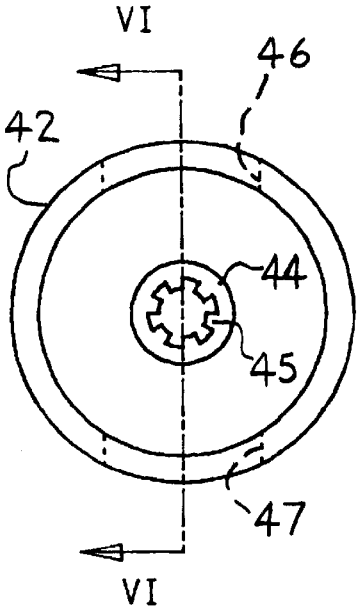
Figure 6:
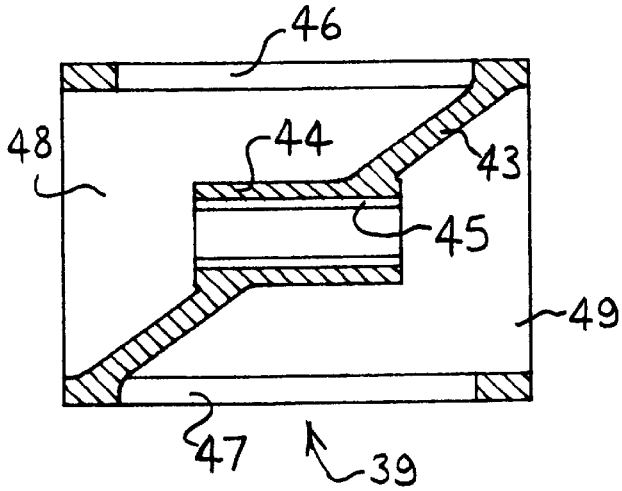
FIG. 6 is a cross section on the line VI—VI of FIG. 5 through the valve member of FIG. 5.

As will be seen in FIGS. 2, 3 and 4 the receiver extends across the central plane P of the engine, i.e. the plane containing the longitudinal axes of the cylinders and the axis 6 of the crankshaft 4. As described above charge is pumped from the pumping parts 13 of the cylinders into the receiver 25 and then passes from the receiver through the working inlet ports 23 to the working part of each cylinder as these ports are uncovered by the top edge of the working part of the piston. The control of the flow of charge into the pumping parts of the cylinders and from the pumping parts into the receiver is controlled by rotary valve members which will now be described.

Referring particularly to FIG. 2, there is a rotary valve control shaft 30 which extends parallel to the crankshaft and is mounted in bearings 31 adjacent the ends thereof The shaft carries balance weights 32 and 33 at its ends and is driven synchronously with the crankshaft 4 by a slip-free drive, e.g. by a toothed belt 34 connecting a toothed wheel 35 on the crankshaft 4 to a toothed wheel 36 on the shaft 30 and which incorporates the balance weight 33. If desired means (not shown) may be provided for varying the timing of the shaft 30 relative to the crankshaft 4.

The balance weights 32, 33 are displaced about the rotary axis of the shaft 30 by 180° and produce a rocking couple which reduces the effect of the unbalanced forces of the pistons, crankshaft and connecting rods which produce a rocking couple.

Referring again to FIG. 2, the shaft 30 carries three rotary valve members 37, 38 and 39, which are identical One of the, the valve member 39, is shown in detail in FIGS. 5 to 8. The valve members are rotatably supported in ported housings 40 and 41 formed in the cylinder block casting. The housing 40 supports the valve members 37 and 38 and the housing 41 supports the valve member 39.

Referring to FIGS. 5 to 8, the valve member 39 includes a cylindrical wall 42 mounted on the shaft 30 by a web 43 inclined to the rotary axis of the shaft 30 and a sleeve 44 which has internal splines 45 to engage the shaft 30. Each rotary valve member is open at its ends and the cylindrical wall 42 is provided with two ports diametrically opposite one another, each of which communicates with one of the open ends of the valve member on each side of the web 43 so that the ports are separated by the web. Thus the rotary valve member 39 has two ports 46 and 47, the port 46 communicates with the open end 48 of the valve member and the port 47 communicates with the open end 49 of the valve member.

Referring now to FIG. 2 the valve member 37 has a port 50 which communicates with the open end 51 of the valve member and a port 52 which communicates with the open end 53 of the valve member. The valve member 38 has a port 54 which communicates with the open end 55 of the valve member and a port 56 which communicates with the open end 57 of the valve member.

The engine includes an induction manifold 59. The open ends 51, 55 and 49 of the valve members 37, 38 and 39 communicate with the induction manifold 59 as do the ports 50, 54 and 46.

The open ends 53 and 57 of the valve members 37 and 38 communicate with the part 28 of the receiver 25 and the open end 48 of the rotary valve 39 communicates with the part 29 of the receiver 25. The ports 50, 54 and 46 communicate, during rotation of the valves by the shaft 30, with pump ports in the respective pumping parts of the cylinders as hereinafter described.

Referring to FIG. 3, this shows the transfer of charge from an induction manifold 59 into the pumping part 13 of one of the cylinders. It is assumed in this figure and in FIG. 4 that the cylinder is the left-hand cylinder of the three cylinders shown in FIGS. 1 and 2 and that the rotary valve member 39 is shown. In the position of the rotary valve member shown, the charge indicated by the arrow 60 enters the open end 49 of the rotary valve member and passes through the port 46 into the pumping part of the cylinder 13 through a pump port 61 as the pumping part 15 of the piston descends.

In FIG. 4, the port 47 in the rotary valve member 39 communicates with the pump port 61 so that as the pumping part 15 of the piston rises the charge indicated by the arrow 62 passes through the ports 61 and 47 and out through the open end 48 of the valve member 39 into the receiver part 29 and thus into the main part of the receiver 25. Each of the rotary valve members 37 and 38 associated with the other two cylinders operates in a similar manner.

FIG. 2 shows that the receiver 25 is common to all three cylinders and extends across the central plane P of the engine. FIGS. 1, 3 and 4 show that the receiver is bounded by an upper wall 63 and a lower wall 64 formed as parts of the cylinder block casting. Referring to FIG. 4, the flow of charge on entering the receiver follows the arrows 62 and 65 and in that figure flows from left to right across the central plane P and around the free end 66 of a baffle 67 in the receiver and then changes its direction to flow from right to left and thus through the working inlet ports 23 into the working parts of the cylinders as these ports are uncovered by the working parts of the pistons in the respective cylinders.

Charge is thus passed from the induction manifold 59 through the rotary valve members 37, 38 and 39 and the pump ports 61 into the respective pumping parts of the cylinders and then transferred from the pumping parts through the rotary valve members into the receiver parts 28 and 29 of the common receiver 25 and then flows around the baffle 67 to change its direction of flow into the working parts of the cylinders through the working inlet ports 23.

The rotary valve members 37, 38 and 39 are so arranged as to allow charge to be induced into the pumping parts of the cylinders and transferred to the receiver and the working parts thereof in accordance with the requirements of the engine. The engine thus far described uses loop scavenging, i.e. the inlet of the charge is in the direction of the arrows 68 shown in FIG. 2 for the right hand cylinder and then the charge loops round to expel the burnt gasses through the exhaust port 22.

The exhaust ports 22 are opened and closed by the upper edge of the working parts of the pistons. However in another arrangement rotary, poppet or other exhaust valves may be provided in the cylinder instead of the exhaust port.

Figure 9:
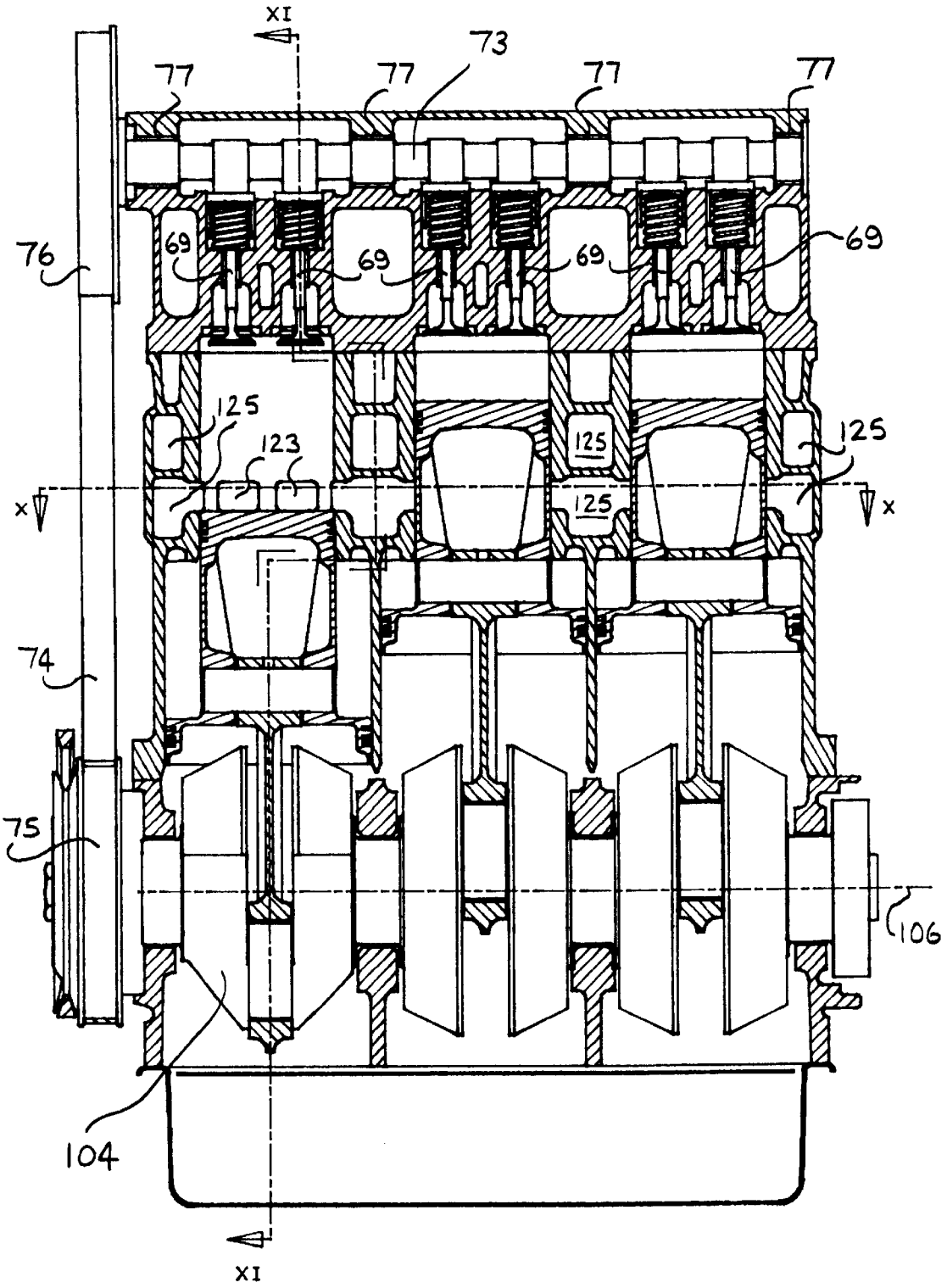
FIG. 9 is a longitudinal section through a three-cylinder, in-line engine in the central plane of the engine, i.e. in the plane of the crank shaft and the cylinder axes but employing uniflow scavenging.
Figure 10:
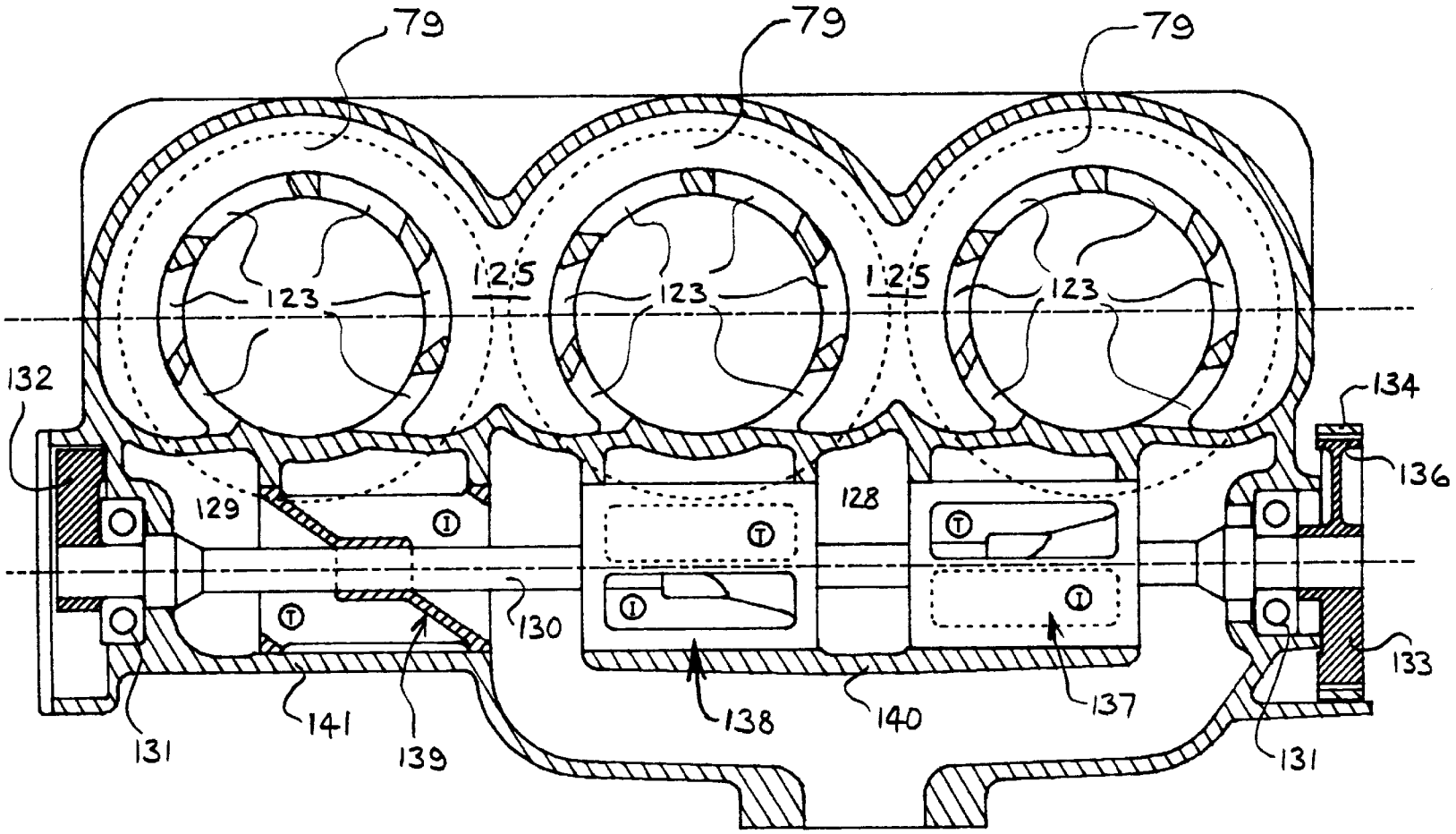
FIG. 10 is a horizontal transverse section of the engine of FIG. 9 on the line X—X of FIG. 9 but with the front of the engine at the right rather than at the left as in FIG. 9.
Figure 11:
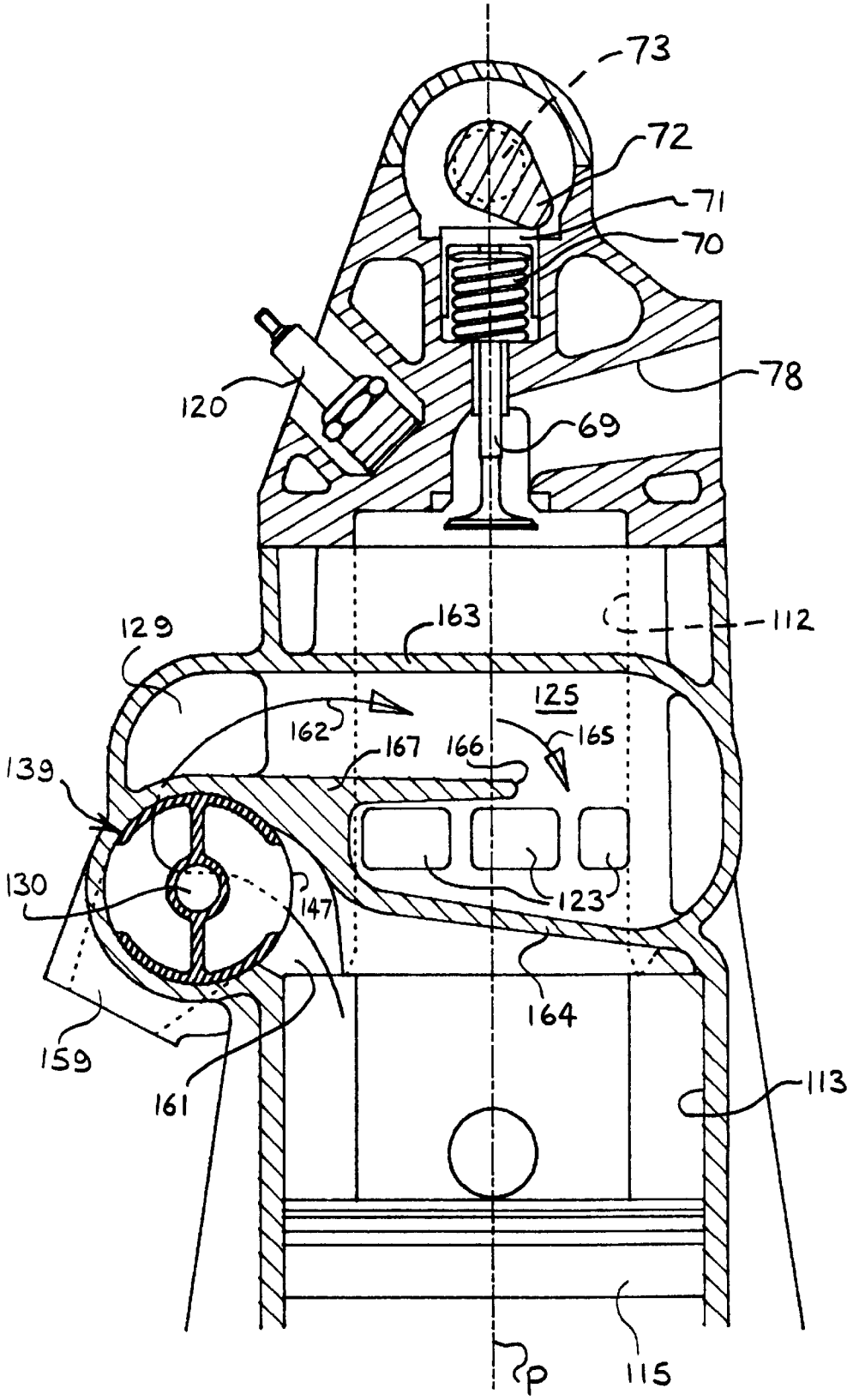
FIG. 11 is a partial transverse section through one of the cylinders of the engine of FIG. 9 on the line XI—XI of FIG. 9 showing the transfer of charge from the pumping part of a cylinder to the receiver with the piston between top and bottom dead centres.

FIGS. 9, 10 and 11 show a three cylinder engine using uniflow scavenging and having exhaust valves in the cylinder head but which is otherwise identical to the engine shown in FIGS. 1 and 2.

Parts in FIGS. 9 to 11 corresponding to identical parts in FIGS. 1, 2 and 4 are shown with the same reference numerals as in the earlier figures but increased by 100.

Referring to FIGS. 9, 10 and 11, in each cylinder head there are two exhaust valves 69 of poppet type each urged closed by a valve spring 70 acting on a tappet 71. The tappets of the valves are operated by cams 72 on a camshaft 73 which is driven from the crankshaft 114 by an internally toothed timing belt 74 engaging toothed wheels 75 and 76 on the crankshaft and the camshaft respectively. The timing belt 74 also drives the rotary valve control shaft 130 via the pulley 136.

The camshaft runs in bearings 77 on the cylinder head and as shown in FIG. 11, exhaust passages 78 in the cylinder head communicate with the valves 69.

As in FIGS. 1 to 3 there is a valve control shaft 130 which drives rotary valve members 137, 138 and 139. These control flow of the charge into the pumping part of each of the cylinders and, as shown in FIG. 11, the flow of the charge from the pumping parts into the receiver 125.

Since the exhaust ports 22 in the engine of FIGS. 1 to 3 are now no longer required, it is possible to have more working inlet ports 123 as shown in FIGS. 10 and 11 which extend in spaced relation around the major part of the circumference of each of the cylinders.

Moreover, the receiver 125 can extend around a major proportion of the circumference of the working part of each cylinder since it is not interrupted as in FIGS. 1 to 3 by the exhaust port 22. The parts of the receiver which are "extra" in FIG. 10 are indicated at 79.

The operation of the engine in FIGS. 9 to 11 in so far as induction and transfer of charge into the receiver 125 is concerned the same as the engine of FIGS. 1 to 4 in that the pumping parts of the cylinders transfer the charge into the receiver 125 which is bounded, as before, in part by the cylindrical walls 121 of the working parts of the cylinders and the working inlet ports 123 are formed in this cylindrical wall and communicate as before directly between the receiver 125 and the working parts of the cylinders, the ports being opened and closed by the tops of the working parts of the pistons.

In the embodiment shown in FIGS. 9 to 11 exhaust is controlled by the exhaust valves 69 which are driven from the crankshaft 124 so that the flow of charge is from the bottom of the working part of each cylinder upwardly and through the exhaust valves 69 and exhaust passages 78.

FIG. 11 shows the baffle 167 around which the charge flows before entering the working inlet ports 123. Where exhaust valves are provided as in this embodiment it may be possible to dispense with or at least modify the shape of the baffle.

Figure 12:
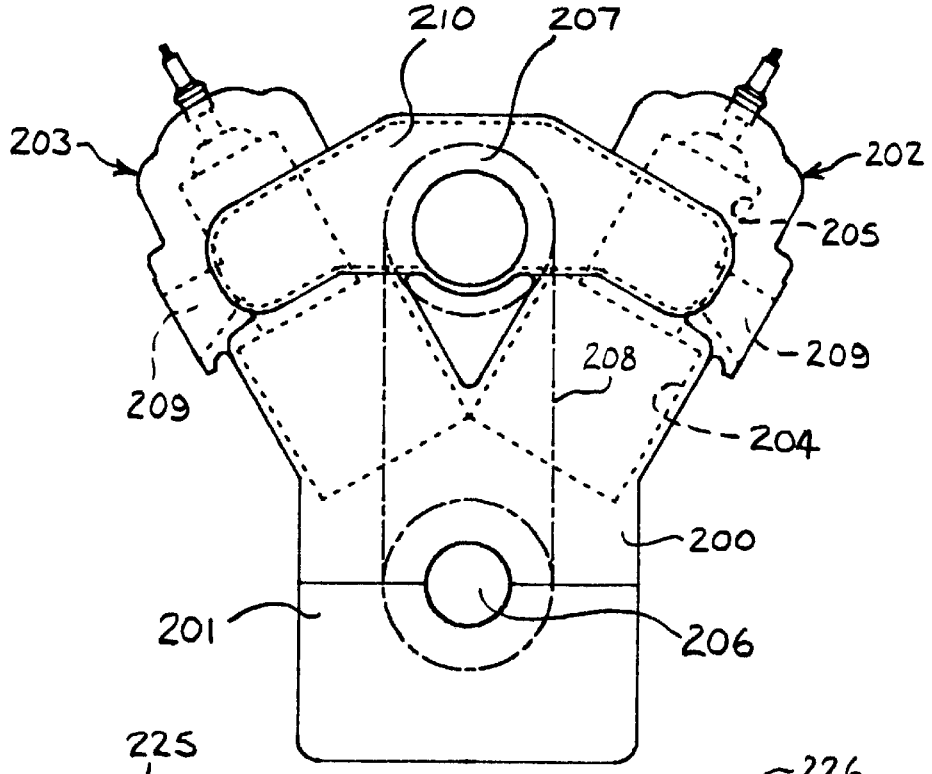
FIG. 12 is a diagrammatic end view of an engine embodying the invention with cylinders in Vee-configuration.

Referring now to FIG. 12, this shows a multiple-cylinder engine with the cylinders arranged in Vee-configuration but having a single receiver. The engine includes a cylinder block 200 and crank case 201. The cylinder block has six cylinders cast therein arranged in two banks 202 and 203 of three cylinders each. It will be appreciated that there could be more or less cylinders in each bank. Each cylinder is of stepped configuration as described in relation to the previous drawings having a larger diameter pumping part 204 and a smaller diameter working part 205 in which a stepped piston operates connected to a crankshaft 206. The engine shown works on the loop scavenge principle as described in relation to FIGS. 1 to 4. The engine includes a single valve control shaft driven by a pulley 207 which in turn is driven from the crankshaft by a toothed belt 208. The valve control shaft carries valve members as described above and is associated with a single receiver 210 which extends along the length of the engine and which communicates with the pumping parts of all the cylinders through ports such as 61 referred to in FIGS. 1 to 4. The receiver 210 also communicates with the receiver space around the working parts 205 of the cylinders, i.e. the receiver space such as 25 shown in FIGS. 1 to 4. Thus the total receiver volume consists of the receiver 210 and the space such as 25 around the working parts of the cylinders.

The operation of the engine is as previously described in that the valve members driven by the pulley 207 via the valve control shaft controls flow of charge into the pumping parts of the cylinders and transfer of the charge from the pumping parts into the receiver and thus through the inlet ports such as 23 into the working parts of the cylinders.

Although the engine in FIG. 12 has been described as having a single rotary valve control shaft carrying valve members it would be possible to have two such shafts, one associated with one bank 202 of the cylinders and the other associated with the other bank 203 of the cylinders. In such case the valve members would be arranged as described in relation to FIG. 2 but would communicate with the receiver 210 which in turn would communicate with the receiver space such as 25 around the cylinders as described above. The cylinders of the engine are provided with exhaust ports 209 which are controlled by the tops of the working parts of the pistons as described in relation to FIGS. 1 to 4.

Figure 13:
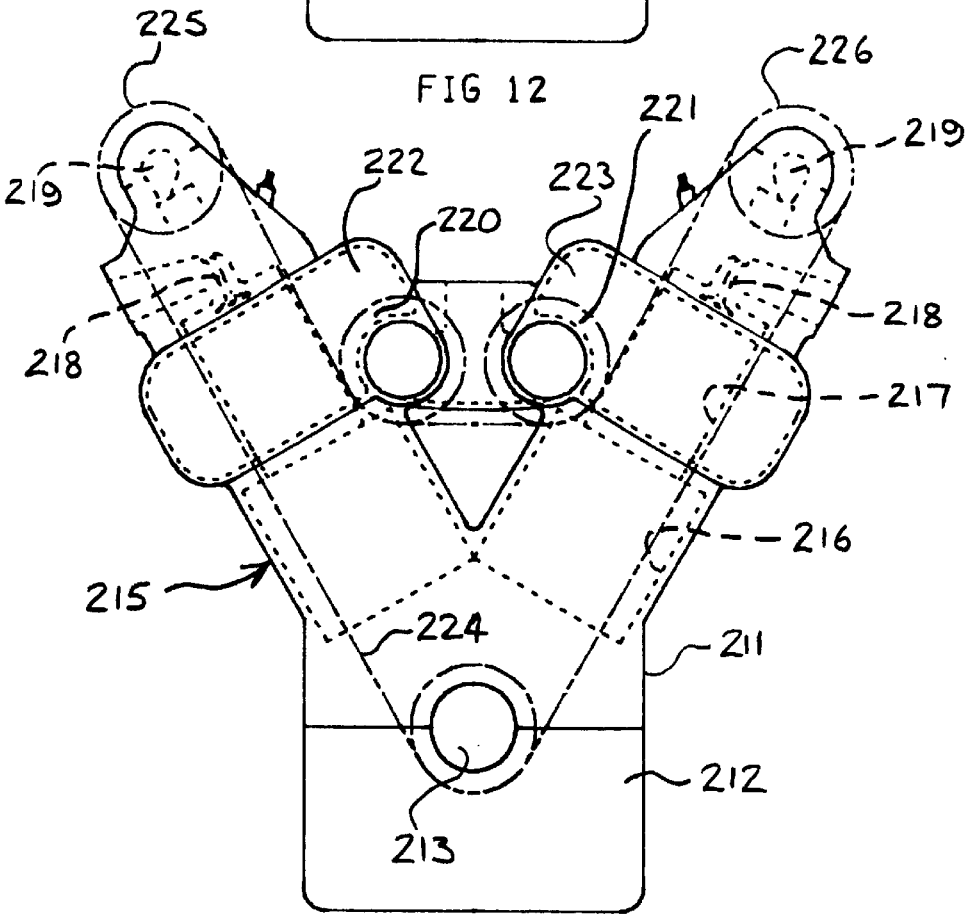
FIG. 13 is a view similar to FIG. 12 of another embodiment with the cylinders in Vee-configuration.

FIG. 13 shows another version of a Vee-configuration engine which uses uniflow scavenging as described in relation to FIGS. 9 to 11. Again there is a cylinder block 211 and a crank case 212 with a crankshaft 213. The banks of cylinders are indicated at 214 and 215 and each may, for example, contain three cylinders although more or less may be provided. As before each cylinder has a larger diameter pumping part 216 and a smaller diameter working part 217 and in this case there are exhaust valves 218 in the working parts and driven by camshafts 219 all as described in relation to FIGS. 9 to 11.

Each of the banks of cylinders is arranged in a manner similar to the three cylinders shown in FIGS. 9 to 11 and there are two valve control shafts driven from pulleys 220 and 221. The valve control shaft driven by the pulley 220 operates valve members to control the charge introduced into the pumping parts of the cylinders in the bank 215 and the transfer of the charge into the working parts of the cylinders in that bank. The valve control shaft driven by the pulley 221 operates valve members which control the introduction of charge into the pumping parts of the cylinders in the bank 214 and the transfer of the charge from those cylinders into the working parts of the cylinders. There are thus two receivers 222 and 223 each of which includes the receiver space such as 125 between the cylinders as described in relation to FIGS. 9 to 11 and each receiver is associated with one of the valve control shafts and valve members.

In effect, the engine of FIG. 13 is substantially two of the engines of FIGS. 9 to 11 with the pistons connected to a common crankshaft. The camshafts and valve control shafts are driven by a toothed belt 224 which goes round the pulleys 220 and 221 and also pulleys 225 and 226 which drive the camshafts. The operation of the engine is substantially as described in relation to FIGS. 9 to 11.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

We claim:

1. A stepped-piston, internal-combustion engine comprising at least one cylinder, the or each cylinder having a longitudinal axis, a working part defined by a cylindrical wall and a pumping part, said pumping part being of greater diameter than the working part, a piston in the or each cylinder and having a working part slidable in the working part of the cylinder and a pumping part slidable in the pumping part of the cylinder, a crankshaft having a rotary axis, the engine having a central plane which contains the rotary axis of the crankshaft and the longitudinal axis of the or each cylinder, means connecting the or each piston to the crankshaft, a receiver which is partly delimited by said cylindrical wall of the working part of the or each of at least some of the cylinders and which extends at least partly around each said working part, working inlet ports in the or each said cylindrical wall and extending between the working part of the or each of said some cylinders and the receiver, at least one valve control member in the form of a rotary shaft mounted for rotation about an axis parallel to the crankshaft axis at a speed dependent on the rotational speed of the crankshaft, valve means driven by said rotary shaft and which comprises, for the or each cylinder, an open-ended valve member defined by a cylindrical wall, the space within said valve member being divided into two parts by a diaphragm inclined to the longitudinal axis of said wall, there being a valve port in said cylindrical wall of the valve member in each of said parts, and wherein during rotation of the shaft one of the valve ports allows the flow of charge through one open end of the valve member into the pumping part of the cylinder and the other of said valve ports allows the flow of charge from the pumping part of the cylinder through the other open end of the valve member into the receiver on one side of said central plane, and means to control the flow of charge from the receiver to the working inlet ports so that all the charge flows from said one side of said central plane, across said plane and then reverses its direction of flow towards said one side of the central plane before reaching said working inlet ports, and wherein the admission of charge into the working part of the or each of said some cylinders from said receiver through the working inlet ports is controlled solely by the uncovering of said working inlet ports by the working part of the piston.

2. An engine as claimed in claim 1, wherein said means to control the flow of charge comprises a baffle in the receiver, said baffle extending across the central plane of the engine from said one side and having, on the side of said central plane remote from said one side, a free end around which the charge passes to reverse its direction of flow before reaching said working inlet ports.

3. A stepped-piston, internal-combustion engine comprising multiple cylinders, the or each cylinder having a longitudinal axis, each cylinder having a working part defined by a cylindrical wall and a pumping part, said pumping part being of greater diameter than the working part, a piston in each cylinder and having a working part slidable in the working part of the cylinder and a pumping part slidable in the pumping part of the cylinder, a crankshaft having a rotary axis, the engine having a central plane which contains the rotary axis of the crankshaft and the longitudinal axes of the cylinders, means connecting each piston to the crankshaft, a receiver which is partly delimited by said cylindrical wall of the working part of at least some of the cylinders and which extends at least partly around each said working part, working inlet ports in each said cylindrical wall and extending between the working part of each of said some cylinders and the receiver, at least one valve control member in the form of a rotary shaft mounted for rotation about an axis parallel to the crankshaft axis at a speed dependent on the rotational speed of the crankshaft, valve means driven by said rotary shaft and which comprises, for each cylinder, an open-ended valve member defined by a cylindrical wall, the space within said valve member being divided into two parts by a diaphragm inclined to the longitudinal axis of said wall, there being a valve port in said cylindrical wall of the valve member in each of said parts, and wherein during rotation of the shaft one of the valve ports allows the flow of charge through one open end of the valve member into the pumping part of the cylinder and the other of said valve ports allows the flow of charge from the pumping part of the cylinder through the other open end of the valve member into the receiver on one side of said central plane, and means to control the flow of charge from the receiver to the working inlet ports so that all the charge flows from said one side of said central plane, across said plane and then reverses its direction of flow towards said one side of the central plane before reaching said working inlet ports, and wherein the admission of charge into the working part of each of said some cylinders from said receiver through the working inlet ports is controlled solely by the uncovering of said working inlet ports by the working part of the piston.

4. An engine as claimed in either of claims 1 or 3 including exhaust port means in said cylindrical wall of the working part of the or each cylinder and which is opened and closed by the working part of the piston in the cylinder and is located on the side of the central plane remote from said one side.

5. An engine as claimed in either of claims 1 or 3 including at least one exhaust valve in the working part of the or each cylinder and which is operated by means driven from said crankshaft.

6. A stepped-piston, internal-combustion engine comprising multiple cylinders arranged in Vee-configuration with two banks of cylinders, each cylinder having a longitudinal axis, each cylinder having a working part defined by a cylindrical wall and a pumping part, said pumping part being of greater diameter than the working part, a piston in each cylinder and having a working part slidable in the working part of the cylinder and a pumping part slidable in the pumping part of the cylinder, a crankshaft having a rotary axis, each bank of cylinders having a central plane which contains the rotary axis of the crankshaft and the longitudinal axes of the cylinders in that bank, means connecting each piston to the crankshaft, two receivers one associated with the cylinders in one of the banks and the other associated with the cylinders in the other of said banks, each receiver being partly delimited by said cylindrical walls of the working parts of all the cylinders in the bank with which the receiver is associated and extending at least partly around each said working part, working inlet ports in each said cylindrical wall and extending between the working part of each of said cylinders in a bank and its associated receiver, two valve control members in the form of rotary shafts mounted for rotation about an axis parallel to the crankshaft axis at a speed dependent on the rotational speed of the crankshaft, valve means driven by each said rotary shaft and which comprises, for each cylinder, an open-ended valve member defined by a cylindrical wall, the space within said valve member being divided into two parts by a diaphragm inclined to the longitudinal axis of said wall, there being a valve port in said cylindrical wall of the valve member in each of said parts, and wherein during rotation of the shaft one of the valve ports allows the flow of charge through one open end of the valve member into the pumping part of the cylinder and the other of said valve ports allows the flow of charge from the pumping part of the cylinder through the other open end of the valve member into the receiver on one side of each of the said central planes of said banks, and means to control the flow of charge from each receiver to the working inlet ports of the cylinders in the bank associated with the receiver so that all the charge flows from said one side of each of said central planes, across said planes and then reverses its direction of flow towards said one sides of the central planes before reaching said working inlet ports, and wherein the admission of charge into the working part of each of said cylinders from its associated receiver through the working inlet ports is controlled solely by the uncovering of said working inlet ports by the working part of the piston.

7. A stepped-piston, internal-combustion engine comprising multiple cylinders arranged in Vee-configuration with two banks of cylinders, the or each cylinder having a longitudinal axis, each cylinder having a working part defined by a cylindrical wall and a pumping part, said pumping part being of greater diameter than the working part, a piston in each cylinder and having a working part slidable in the working part of the cylinder and a pumping part slidable in the pumping part of the cylinder, a crankshaft having a rotary axis, each bank of cylinders having a central plane which contains the rotary axis of the crankshaft and the longitudinal axes of the cylinders in that bank, means connecting each piston to the crankshaft, a receiver which is partly delimited by said cylindrical wall of the working part of all the cylinders and which extends at least partly around each said working part, working inlet ports in each said cylindrical wall and extending between the working part of each of said cylinders and the receiver, a valve control member in the form of a rotary shaft mounted for rotation about an axis parallel to the crankshaft axis at a speed dependent on the rotational speed of the crankshaft, valve means driven by said rotary shaft and which comprises, for each cylinder, an open-ended valve member defined by a cylindrical wall, the space within said valve member being divided into two parts by a diaphragm inclined to the longitudinal axis of said wall, there being a valve port in said cylindrical wall of the valve member in each of said parts, and wherein during rotation of the shaft one of the valve ports allows the flow of charge through one open end of the valve member into the pumping part of the cylinder and the other of said valve ports allows the flow of charge from the pumping part of the cylinder through the other open end of the valve member into the receiver on one side of each of the said central planes of said banks, and means to control the flow of charge from the receiver to the working inlet ports so that all the charge flows from said one side of each of said central planes, across said planes and then reverses its direction of flow towards said one sides of the central planes before reaching said working inlet ports, and wherein the admission of charge into the working part of each of said some cylinders from said receiver through the working inlet ports is controlled solely by the uncovering of said working inlet ports by the working part of the piston.

8. An engine as claimed in either of claims 6 or 7 including exhaust port means in said cylindrical wall of the working part of the or each cylinder which is opened and closed by the working part of the piston in the cylinder and is located on the side of the central plane remote from said one side.

9. An engine as claimed in either of claims 6 or 7 including at least one exhaust valve in the working part of the or each cylinder and which is operated by means driven from said crankshaft.

* * * * *